US011393406B2

(12) United States Patent
Na

(10) Patent No.: US 11,393,406 B2
(45) Date of Patent: Jul. 19, 2022

(54) SEMICONDUCTOR INTEGRATED CIRCUIT FOR DRIVING DISPLAY DEVICE

(71) Applicant: SILICON WORKS CO., LTD., Daejeon (KR)

(72) Inventor: Young Sun Na, Daejeon (KR)

(73) Assignee: SILICON WORKS CO., LTD., Daejeon (KR)

( * ) Notice: Subject to any disclaimer, the term of this patent is extended or adjusted under 35 U.S.C. 154(b) by 0 days.

(21) Appl. No.: 17/035,052

(22) Filed: Sep. 28, 2020

(65) Prior Publication Data

US 2021/0118376 A1 Apr. 22, 2021

(30) Foreign Application Priority Data

Oct. 16, 2019 (KR) ..... 10-2019-0128479

(51) Int. Cl.

| | |
|---|---|
| ***G09G 3/3275*** | (2016.01) |
| ***G09G 3/3258*** | (2016.01) |
| ***G09G 3/3266*** | (2016.01) |
| ***G09G 3/20*** | (2006.01) |

(52) U.S. Cl.

CPC ..... *G09G 3/3275* (2013.01); *G09G 3/2003* (2013.01); *G09G 3/3258* (2013.01); *G09G 3/3266* (2013.01); *G09G 2310/027* (2013.01); *G09G 2310/08* (2013.01); *G09G 2320/0252* (2013.01); *G09G 2320/0673* (2013.01)

(58) Field of Classification Search

None

See application file for complete search history.

(56) References Cited

U.S. PATENT DOCUMENTS

| | | | | |
|---|---|---|---|---|
| 10,078,980 | B2 | 9/2018 | Kong et al. | |
| 2008/0170027 | A1* | 7/2008 | Kyeong | G09G 3/3688 345/100 |
| 2009/0284512 | A1* | 11/2009 | Fan | G09G 3/3696 345/211 |
| 2013/0057531 | A1 | 3/2013 | Lim et al. | |
| 2015/0170594 | A1* | 6/2015 | Cho | G09G 3/3291 345/690 |
| 2015/0187304 | A1* | 7/2015 | Ko | G06F 1/3265 345/208 |
| 2017/0076694 | A1* | 3/2017 | Shin | G09G 3/2003 |
| 2021/0012705 | A1* | 1/2021 | Pyun | G09G 3/32 |

FOREIGN PATENT DOCUMENTS

KR 10-2017-0032911 A 3/2017

* cited by examiner

*Primary Examiner* — Kenneth Bukowski

(74) *Attorney, Agent, or Firm* — Fenwick & West LLP

(57) ABSTRACT

The present disclosure relates to a semiconductor integrated circuit for driving a display, and more particularly, to a semiconductor integrated circuit for driving a display to supply gamma voltages to respective DACs through a gamma bus to which a plurality of gamma voltage circuits are connected.

13 Claims, 9 Drawing Sheets

SEMICONDUCTOR INTEGRATED CIRCUIT FOR DRIVING DISPLAY DEVICE

CROSS REFERENCE TO RELATED APPLICATION

This application claims priority from Republic of Korea Patent Application No. 10-2019-0128479, filed on Oct. 16, 2019, which is hereby incorporated by reference in its entirety.

BACKGROUND

1. Field of Technology

The present disclosure relates to a semiconductor integrated circuit for driving a display device.

2. Description of the Prior Art

As society becomes more and more information-oriented, the demand for products requiring display devices has increased. Recently, various display devices, such as liquid crystal display devices, plasma display devices, organic light emitting diode display devices, or the like, are used.

Accordingly, various technologies for improving the image quality of a display device are being developed. One of them is a technology for driving a display panel at high speed. Since the number of pixels disposed on a display panel increases in order to enhance the image quality, a technology for driving a display panel at high speed is necessary in order to drive all the numerous pixels for the same period of time as before or for a shorter period of time than before.

A display panel may be driven by a data driving device referred to as a source driver, a column driver, or the like and the aforementioned high-speed driving technology is related to a data driving device. A data driving device generally receives image data indicating a greyscale of each pixel, converts the image data into a data voltage, which is in an analog form, and supplies the data voltage to each pixel to drive a display panel. In order to drive a display panel at high speed, the aforementioned procedure needs to be carried out at high speed.

SUMMARY

An aspect of the present disclosure is to provide a technology for driving a display panel at high speed. Another aspect of the present disclosure is to provide a technology for processing signals at high speed in a data driving device. Still another aspect of the present disclosure is to provide a technology for processing signals at high speed in a data driving device implemented in a form of a semiconductor integrated circuit (IC).

To this end, an embodiment of the present disclosure provides a semiconductor integrated circuit comprising a plurality of channel circuits, a gamma bus, and a plurality of gamma voltage circuits.

The semiconductor integrated circuit, which is for a display driver, may be formed of a single semiconductor package or one integrated circuit.

Each channel circuit may comprise a digital-analog converter (DAC), to select one of a plurality of gamma voltages according to pixel image data and to generate a data voltage, and supply the data voltage to a data line connected with sub pixels.

The gamma bus may provide a path through which the plurality of gamma voltages are transmitted to the DAC of each channel circuit.

Each gamma voltage circuit may generate the plurality of gamma voltages by dividing reference voltages and be connected with the gamma bus at divided points.

The plurality of channel circuits may be disposed along a first direction and the plurality of gamma voltage circuits may be disposed along the first direction to be spaced apart from each other.

Each pixel may comprise a plurality of sub-pixels and the gamma bus may comprise a plurality of sub gamma buses. A channel circuit driving a first sub-pixel among the plurality of sub-pixels and a channel circuit driving a second sub-pixel may be connected with a first sub gamma bus and a channel circuit driving a third sub-pixel may be connected with a second sub gamma bus. Here, the number of gamma voltage circuits connected with the first sub gamma bus may be greater than the number of gamma voltage circuits connected with the second sub gamma bus.

Each gamma voltage circuit may comprise a first resistor string to divide reference voltages, a decoder to select a plurality of intermediate voltages from the first resistor string, gamma buffers to buffer the plurality of intermediate voltages, and a second resistor string to generate the plurality of gamma voltages by dividing voltages outputted from the gamma buffers. Here, the decoder may receive a decoding signal and select the plurality of intermediate voltages according to the decoding signal.

Each sub-pixel may comprise red (R), green (G), or blue (B) organic light emitting diodes (OLEDs) and the plurality of gamma voltages may have different gamma curves for respective RGB OLEDs. The semiconductor integrated circuit may comprise separate gamma voltage circuits for respective color sub-pixels in order that different gamma curves are formed for the respective RGB OLEDs.

Each DAC may comprise a switch array comprising a plurality of switches and select one of the plurality of gamma voltages by turning on one of the plurality of switches.

The plurality of gamma voltage circuits may be provided with the reference voltages from a same source.

Another embodiment provides a semiconductor integrated circuit comprising a timing control circuit, a plurality of channel circuits, a gamma bus, and a plurality of gamma voltage circuits.

The semiconductor integrated circuit, which is for a display drive, may be a single semiconductor package or one integrated circuit (IC).

The timing control circuit may supply a synchronization signal for a display period and pixel image data to a data driving circuit comprising the plurality of channel circuits.

Each channel circuit may comprise a digital-analog converter (DAC), to select one of a plurality of gamma voltages according to the pixel image data and to generate a data voltage, and supply the data voltage to a data line connected with sub-pixels.

The gamma bus may provide a path through which the plurality of gamma voltages are transmitted to the DAC of each channel circuit.

Each gamma voltage circuit may generate the plurality of gamma voltages by dividing reference voltages and be connected with the gamma bus at divided points.

The semiconductor integrated circuit may further comprise a data bus to transfer the pixel image data. Each channel circuit may further comprise a latch circuit to latch the pixel image data from the data bus.

The semiconductor integrated circuit may further comprise a gate driving circuit to generate a gate driving signal of a thin film transistor (TFT) disposed in each sub-pixel according to a control signal received from the time control circuit.

The semiconductor integrated circuit may further comprise a plurality of output pads respectively connected with data lines. The plurality of channel circuits may be disposed in parallel with the plurality of output pads and the plurality of gamma voltage circuits may be disposed among the plurality of channel circuits at regular intervals.

The plurality of channel circuits may be divided into a plurality of channel circuit blocks by the plurality of gamma voltage circuits. The sizes of the outermost channel circuit blocks may be smaller than the sizes of inner channel circuit blocks.

A gamma voltage circuit may receive a decoding signal and adjust a plurality of gamma voltages according to the decoding signal. The timing control signal may transmit the decoding signals to the respective gamma voltage circuits.

As described above, according to the present disclosure, it is possible to drive a display panel at high speed and it is possible to process signals in the data driving device at high speed.

DETAILED DESCRIPTION

Figure 1:
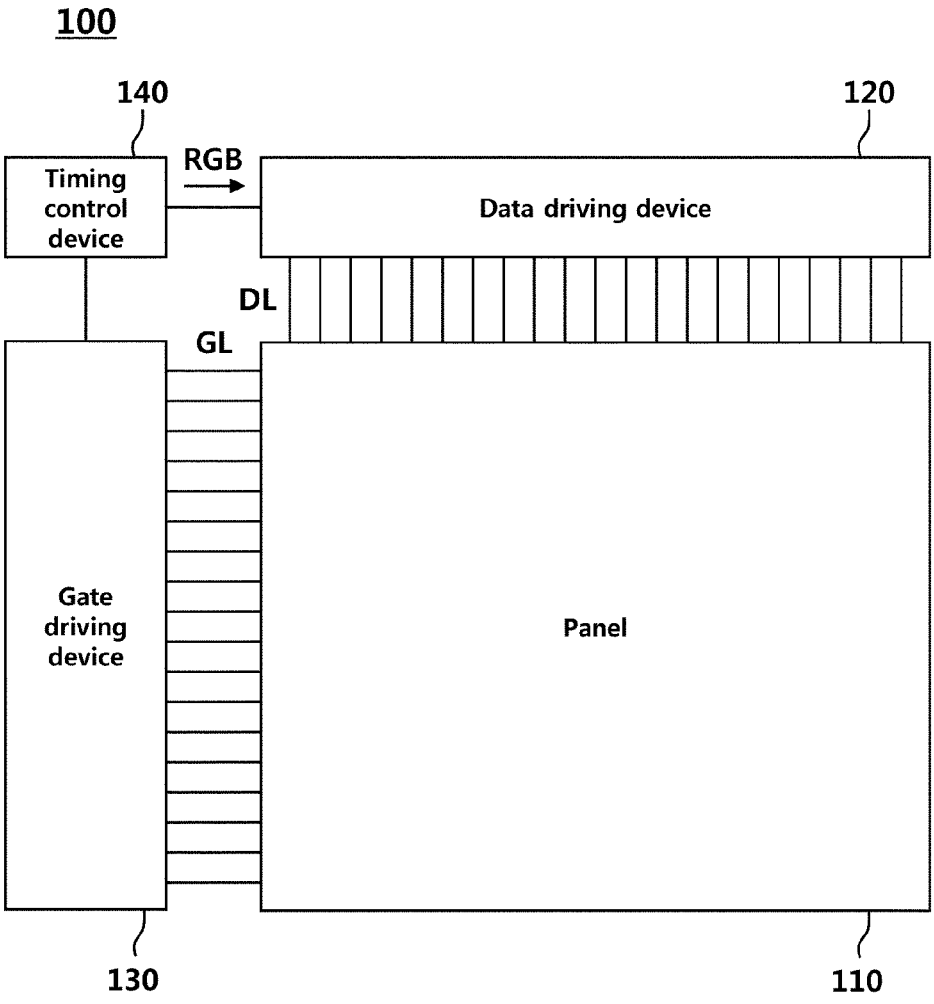
FIG. 1 is a configuration diagram of a display device according to an embodiment.

FIG. 1 is a configuration diagram of a display device according to an embodiment.

Referring to FIG. 1, a display device 100 may comprise a panel 110, a data driving device 120, a gate driving device 130, and a timing control device 140.

On the panel 110, a plurality of data lines DL and a plurality of gate lines GL may be disposed and a plurality of sub-pixels may be disposed in a form of a matrix. Each sub-pixel may be connected with a data line DL according to a scan signal supplied through a gate line GL. In addition, the brightness of each sub-pixel may be adjusted according to a data voltage supplied through a data line DL.

The panel 110 may be a liquid crystal display (LCD) panel, an organic light emitting diode (OLED) panel, or other types of panels. If the panel 110 is an OLED panel, an OLED and a plurality of transistors connected with the OLED may be disposed in each sub-pixel. A gate line GL and a data line DL may be connected with the plurality of transistors of each sub-pixel. When a scan signal indicating a turn-on is supplied through the gate line GL, one of the plurality of transistors may be turned on and the data line DL may be connected with a gate of another transistor. Depending on the level of a data voltage supplied through the data line DL, the level of a current flowing to the aforementioned another transistor is adjusted so as to adjust the brightness of the OLED. Hereinafter, embodiments in which the panel 110 is an OLED panel will be described for the convenience of description, however, the present disclosure is not limited thereto.

The gate driving device 130 may supply a scan signal through a gate line GL and the data driving device 120 may supply a data voltage through a data line DL. The gate driving device 130 and the data driving device 120 may receive a control signal or a synchronization signal from the timing control device 140 and determine a driving timing of each sub-pixel according to the control signal or the synchronization signal.

The timing control device 140 may transmit image data RGB indicating a greyscale of each sub-pixel to the data driving device 120. The timing control device 140 may receive image data RGB from an external device, convert the image data RGB to be suitable for the data driving device 120, and transmit converted image data to the data driving device 120. When the panel 110 is an OLED panel, the timing control device 140 may detect a change of characteristics of each sub-pixel of the OLED panel, convert image data RGB such that the change of characteristics is compensated, and transmit converted image data to the data driving device 120.

The data driving device 120 may extract pixel image data for each sub-pixel from the image data RGB, generate a data voltage according to the pixel image data, and supply the generated data voltage through a data line DL connected with each sub-pixel.

A data driving device 120 may be implemented in a form of a semiconductor integrated circuit. When a data driving device 120 is implemented in a form of a semiconductor integrated circuit, circuits forming the data driving device 120 may be implemented in a form of an integrated circuit and enclosed with a semiconductor package. A data driving device 120, a gate driving device 130, and a timing control device 140, each may be implemented in a form of a separate semiconductor integrated circuit or all may be implemented in a form of one single semiconductor integrated circuit. For example, a data driving device 120, a gate driving device 130, and a timing control device 140 all may be comprised in a single semiconductor package.

Figure 2:
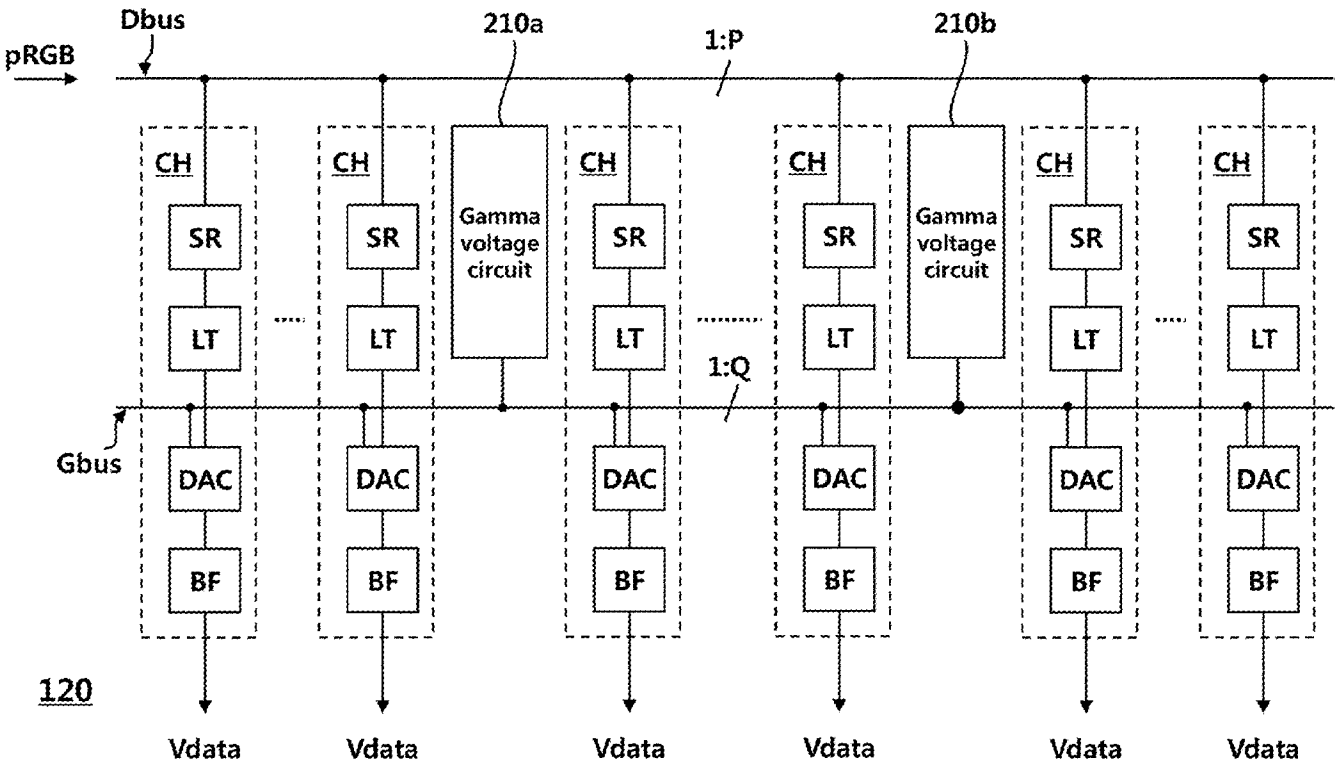
FIG. 2 is a configuration diagram of a data driving device according to an embodiment.

FIG. 2 is a configuration diagram of a data driving device according to an embodiment.

Referring to FIG. 2, the data driving device 120 may comprise a plurality of channel circuits CH, a plurality of gamma voltage circuits 210*a*, 210*b*, a data bus Dbus, and a gamma bus Gbus.

The data driving device 120 may receive image data from a data processing circuit (not shown), extract pixel image data pRGB from the image data, and transmit the pixel image data pRGB to the data bus Dbus.

The data bus Dbus, which is a parallel communication bus, may comprise as many bus lines as the number of bits of pixel image data pRGB. For example, in a case when pixel image data pRGB comprises P (P is a natural number) bits, a data bus Dbus may comprise P bus lines.

Pixel image data pRGB transmitted to the data bus Dbus may sequentially or non-sequentially be allotted to the respective channel circuits CH by shift registers.

A channel circuit CH may comprise a shift register SR, a latch LT, a digital-analog converter (DAC), and an output buffer BF. Pixel image data pRGB transmitted to the data bus Dbus may temporarily be stored in the latch LT by the shift register SR, and then, may be converted into a data voltage Vdata in an analog form in the DAC. The data voltage Vdata may be outputted to a data line by the output buffer BF.

The data driving device 120 may comprise two buses. One is a data bus Dbus through which pixel image data pRGB is transmitted, and the other is a gamma bus Gbus through which gamma voltages are transmitted.

The DAC may be provided with a plurality of gamma voltages through the gamma bus Gbus. The DAC, then, may select one of the plurality of gamma voltages according to pixel image data pRGB and generate a data voltage Vdata.

Gamma voltages may be generated by the gamma voltage circuits 210*a*, 210*b*. The gamma voltage circuits 210*a*, 210*b* may generate gamma voltages and supply the gamma voltages to the DAC through the gamma bus Gbus.

To the gamma bus Gbus, the plurality of gamma voltage circuits 210*a*, 210*b* may be connected. In a case when only one gamma voltage circuit is used, a RC delay increases as a channel circuit is located farther from the gamma voltage circuit, and this may cause a limit on the driving speed of a channel circuit. A designer may increase driving currents or bias currents for the gamma voltage circuit in order to relax the limit, however, this may result in an increase of the size of the gamma voltage circuit, in particular, the height thereof.

According to an embodiment, the data driving device 120 may improve the gamma voltage supply capacity and reduce the aforementioned RC delay by connecting the plurality of gamma voltage circuits 210*a*, 210*b* to the gamma bus Gbus.

The channel circuits CH may be connected with the gamma voltage circuits 210*a*, 210*b* through the gamma bus Gbus. Such an embodiment has an advantage that the wiring is simpler than the case when the channel circuits are connected with the gamma voltage circuits in a 1:1 way.

The gamma bus Gbus may comprise a plurality of bus lines. The gamma bus Gbus may comprise Q (Q is a natural number) bus lines. Here, in a case when pixel image data pRGB comprise P bits, the relation between P and Q, which is the number of bus lines of the gamma bus Gbus, may be $Q<=2^P$.

In one embodiment, the plurality of gamma voltage circuits 210*a*, 210*b* are disposed to be spaced apart from each other along the gamma bus Gbus. When the gamma voltage circuits 210*a*, 210*b* are respectively assigned to predetermined areas to supply gamma voltages along the gamma bus Gbus, all the channel circuits CH may uniformly be provided with gamma voltages.

Figure 3:
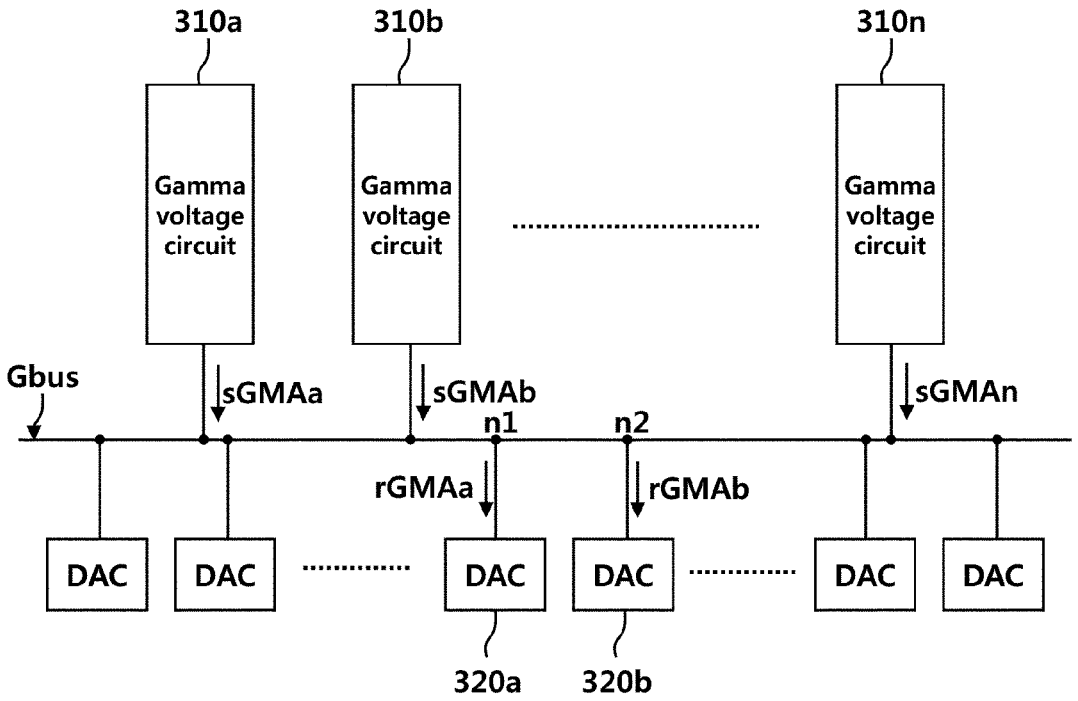
FIG. 3 is a diagram illustrating the arrangement of gamma voltage circuits and DACs according to an embodiment.

FIG. 3 is a diagram illustrating the arrangement of gamma voltage circuits and DACs according to an embodiment.

Referring to FIG. 3, a plurality of gamma voltage circuits 310*a*, 310*b*, . . . , 310*n* and a plurality of DACs may be connected to the gamma bus Gbus.

The plurality of gamma voltage circuits 310*a*, 310*b*, . . . , 310*n* may be disposed to be spaced apart from each other along the gamma bus. Here, the respective distances between the two adjacent gamma voltage circuits may be practically the same. Or, the respective numbers of the DACs disposed between the two adjacent gamma voltage circuits may be practically the same.

Each gamma voltage circuit may output a s gamma voltage and s gamma voltages outputted from the respective gamma voltage circuits may be different. For example, a first s gamma voltage sGMAa outputted from a first gamma voltage circuit 310*a*, a second s gamma voltage sGMAb outputted from a second gamma voltage circuit 310*b*, and a Nth s gamma voltage sGMAn outputted from a Nth gamma voltage circuit 310*n* may be different from each other. In a case when gamma voltages used by two adjacent DACs are greatly different, there might be defects in image quality, such as vertical lines on a panel. However, the data driving device adopting a structure using the gamma bus Gbus according to an embodiment may allow decreasing the probability of such defects in image quality.

For example, in an embodiment, adjacent first and second DACs 320*a*, 320*b* are not affected much by the voltage differences among the gamma voltage circuits 310*a*, 310*b*, . . . , 310*n*. The adjacent first and second DACs 320*a*, 320*b* may practically be affected by voltages of connection nodes n1, n2 in the gamma bus Gbus. However, if the adjacent first and second DACs 320*a*, 320*b* are respectively connected with the nodes n1, n2 which are sufficiently close to each other, the difference between the voltages of the respective nodes n1, n2 is not great, and accordingly, the difference between r gamma voltages rGMAa, rGMAb respectively received by the nodes n1, n2 is not great, either.

Figure 4:
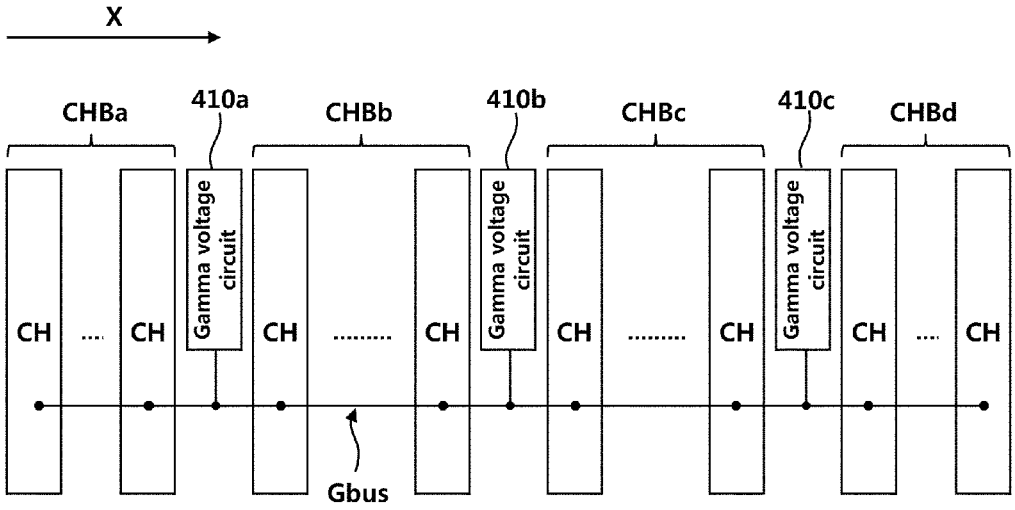
FIG. 4 is a diagram illustrating the arrangement of gamma voltage circuits and channel circuits according to an embodiment.

FIG. 4 is a diagram illustrating the arrangement of gamma voltage circuits and channel circuits according to an embodiment.

Referring to FIG. 4, a plurality of channel circuits CH may be divided into a plurality of channel circuit blocks CHBa, CHBb, CHBc, CHBd, and each of gamma voltage circuits 410*a*, 410*b*, 410*c* may be disposed between two adjacent channel circuit blocks.

The plurality of channel circuits CH and the plurality of channel circuit blocks CHBa, CHBb, CHBc, CHBd may be disposed along a first direction X, for example, along a transversal direction of the panel, and a plurality of gamma voltage circuits 410*a*, 410*b*, 410*c* may be disposed to be spaced apart from each other along the first direction X.

Loads of the channel circuits that the respective gamma voltage circuits 410*a*, 410*b*, 410*c* bear may be practically equal. For such equal distribution of loads, the sizes of the outermost channel circuit blocks CHBa, CHBd may be smaller than the sizes of the inner channel circuit blocks CHBb, CHBc. For example, the sizes of the outermost channel circuit blocks CHBa, CHBd may be about half of the size of the inner channel circuit blocks CHBb, CHBc. Here, the size may mean an area of a circuit or the number of channel circuits included in a channel circuit block.

The gamma bus Gbus may be disposed to traverse the plurality of channel circuits CH and the plurality of channel circuit blocks CHBa, CHBb, CHBc, CHBd along the first direction X. The plurality of gamma voltage circuits 410*a*, 410*b*, 410*c* may be disposed on one side of a plane divided into two by the gamma bus Gbus.

In a panel, a pixel may comprise a plurality of sub-pixels. A data driving device may comprise gamma voltage circuits for the respective sub-pixels in order to supply different gamma voltages to the respective different types of sub-pixels.

Figure 5:
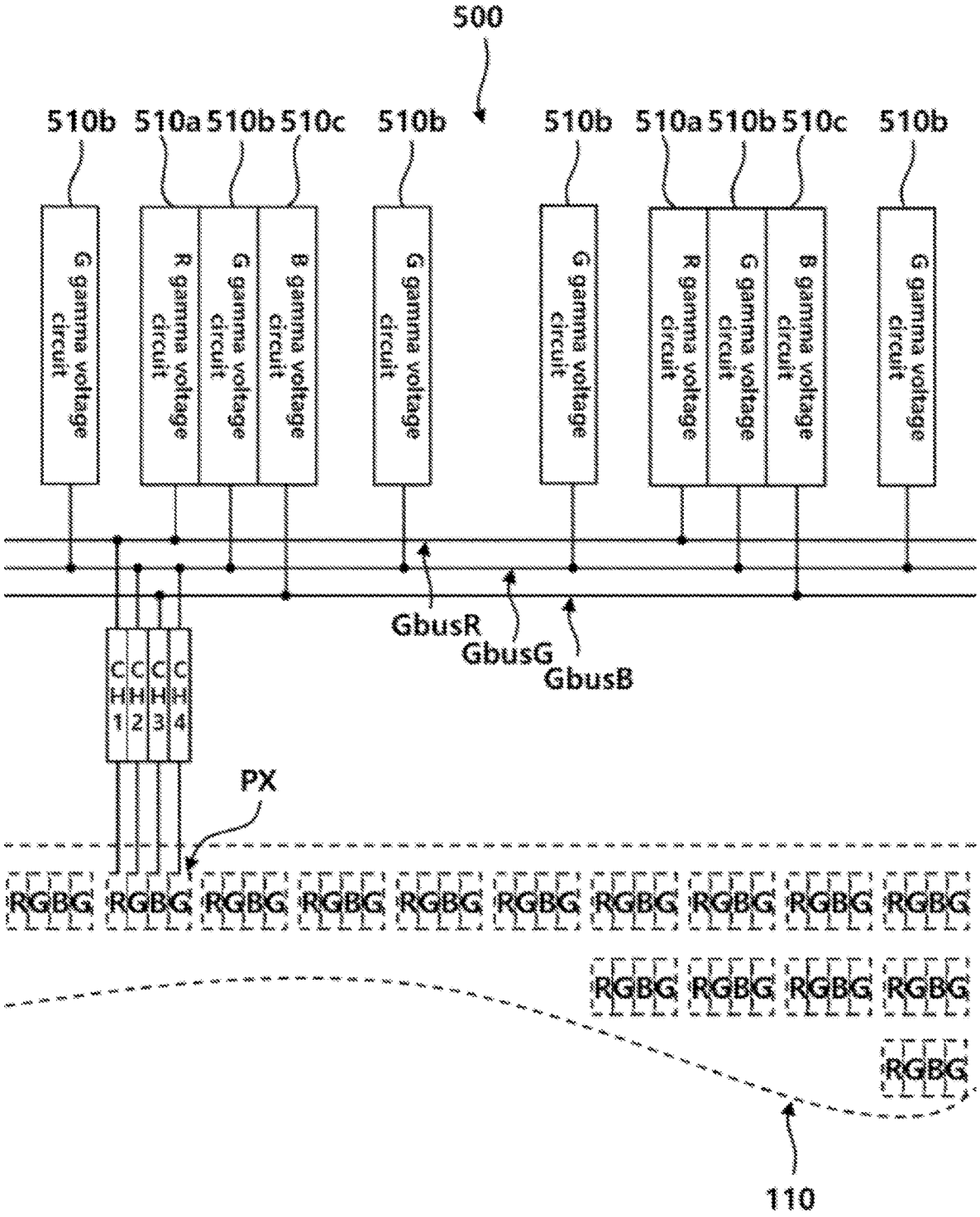
FIG. 5 is a diagram of an example of the arrangement of gamma voltage circuits for respective sub-pixels according to an embodiment.

FIG. 5 is a diagram of an example of the arrangement of gamma voltage circuits for respective sub-pixels.

Referring to FIG. 5, in the panel 110, each pixel PX may comprise a plurality of sub-pixels (R: red, G: green, B: blue, G: green). The respective sub-pixels may have different colors, but some of the sub-pixels may have the same color.

For example, a pixel PX may comprise a red sub-pixel R, a green sub-pixel G, a blue sub-pixel B, and one more green sub-pixel G. For another example, a pixel PX may comprise a red sub-pixel R, a green sub-pixel G, a blue sub-pixel B, and a white sub-pixel W.

The data driving device may have at least one gamma voltage circuit for each sub-pixel comprised in a pixel PX. For example, in a case when a pixel PX comprises four sub-pixels, the data driving device may comprise a gamma voltage circuit for a first sub-pixel, a gamma voltage circuit for a second sub-pixel, a gamma voltage circuit for a third sub-pixel, and a gamma voltage circuit for a fourth sub-pixel. Additionally, the data driving device may comprise a plurality of gamma voltage circuits for each sub-pixel. For example, the data driving device may comprise a plurality of gamma voltage circuits for the first sub-pixel and a plurality of gamma voltage circuits for the second sub-pixel.

The data driving device may comprise at least one gamma voltage circuit for each type of sub-pixel. For example, the data driving device may comprise at least one R gamma voltage circuit 510*a* for supplying gamma voltages to red sub-pixels, at least one G gamma voltage circuit 510*b* for supplying gamma voltages to green sub-pixels, and at least one B gamma voltage circuit 510*c* for supplying gamma voltages to blue sub-pixels.

The gamma bus may comprise a plurality of sub gamma buses GbusR, GbusG, GbusB. Each pixel PX may comprise a plurality of sub-pixels RGBG. A channel circuit CH2 that drives a first sub-pixel (for example, a green sub-pixel) among a plurality of sub-pixels and a channel circuit CH4 that drives a second sub-pixel (for example, another green sub-pixel) may be connected with a first sub gamma bus GbusG. A channel circuit CH1 that drives a third sub-pixel (for example, a red sub-pixel) may be connected with a second sub gamma bus GbusR and a channel circuit CH3 that drives a fourth sub-pixel (for example, a blue sub-pixel) may be connected with a third sub gamma bus GbusB.

Here, the number of gamma voltage circuits (for example, G gamma voltage circuits 510*b*) connected with the first sub gamma bus GbusG may be greater than the number of gamma voltage circuits (for example, R gamma voltage circuits 510*a*) connected with the second sub gamma bus GbusR or the number of gamma voltage circuits (for example, B gamma voltage circuits 510*c*) connected with the third sub gamma voltage bus GbusB.

For another example, a channel circuit that drives a first sub-pixel (for example, a green sub-pixel) among a plurality of sub-pixels and a channel circuit that drives a second sub-pixel (for example, another green sub-pixel) may be connected with a sub gamma bus (not shown), whereas a channel circuit that drives a third sub-pixel (for example, a red sub-pixel) and a channel circuit that drives a fourth sub-pixel (for example, a blue sub-pixel) may be connected with another sub gamma bus (not shown). Here, the gamma bus may comprise two sub gamma buses.

Figure 6:
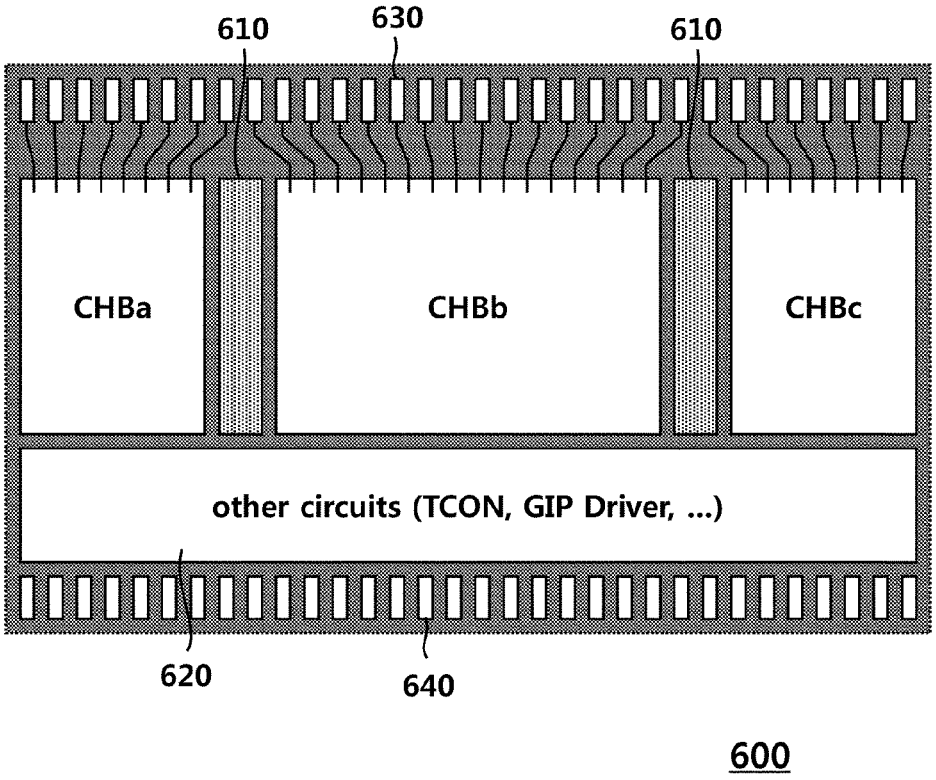
FIG. 6 is a diagram illustrating the arrangement of a semiconductor integrated circuit according to an embodiment.

FIG. 6 is a diagram illustrating the arrangement of a semiconductor integrated circuit according to an embodiment.

Referring to FIG. 6, on a semiconductor integrated circuit 600, a plurality of channel circuit blocks CHBa, CHBb, CHBc, a plurality of gamma voltage circuits 610, a block of other circuits 620, a plurality of output pads 630, and a plurality of input pads 640 may be disposed.

Each channel circuit block CHBa, CHBb, CHBc may comprise a plurality of channel circuits and the channel circuits may respectively comprise DACs sharing a gamma bus. Each of the gamma voltage circuits 610 may be disposed between the two adjacent channel circuit blocks CHBa, CHBb, CHBc. Here, the areas of the outermost channel circuit blocks CHBa, CHBc may be smaller than the area of the inner channel circuit block CHBb.

Channel circuits comprised in the channel circuit blocks CHBa, CHBb, CHBc may respectively be connected with the output pads 630. The output pads 630 may respectively be connected with data lines.

The plurality of channel circuits may be disposed in parallel with a direction in which the output pads 630 are disposed, and the plurality of gamma voltage circuits 610 may be disposed to be spaced apart from each other along the direction in which the output pads 630 are disposed.

The channel circuit blocks CHBa, CHBb, CHBc and the gamma voltage circuits 610 may be disposed proximately to the output pads 630, whereas the block of other circuits 620 may be disposed proximately to the input pads 640.

The block of other circuits 620 may comprise a gate driving device and a timing control device. The gate driving device may receive a synchronization signal from the timing control device, generate a gate control signal, and then, transmit the gate control signal to a gate-in-panel (GIP) circuit. The timing control device may receive image data from an external device, process the image data, and transmit the image data to the data driving device comprising the channel circuit blocks CHBa, CHBb, CHBc. The block of other circuits 620 may further comprise a random access memory (RAM), communication circuits, a DC-DC converter.

The timing control device may transmit a signal (for example, a decoding signal) to control the gamma voltage circuits 610 to the data driving device. The gamma voltage circuits 610 may adjust a gamma curve or perform other controls using such a signal. In a case when a timing control device and a plurality of gamma voltage circuits 610 are comprised in a semiconductor integrated circuit 600, it is easier for the timing control device to control each gamma voltage circuit 610 using a separate signal. In a case when a plurality of gamma voltage circuits 610 are disposed in a semiconductor integrated circuit, there could be differences among the gamma voltage circuits 610. However, in the aforementioned structure, the timing control device may minimize the differences by separately controlling the respective gamma voltage circuits 610.

Figure 7:
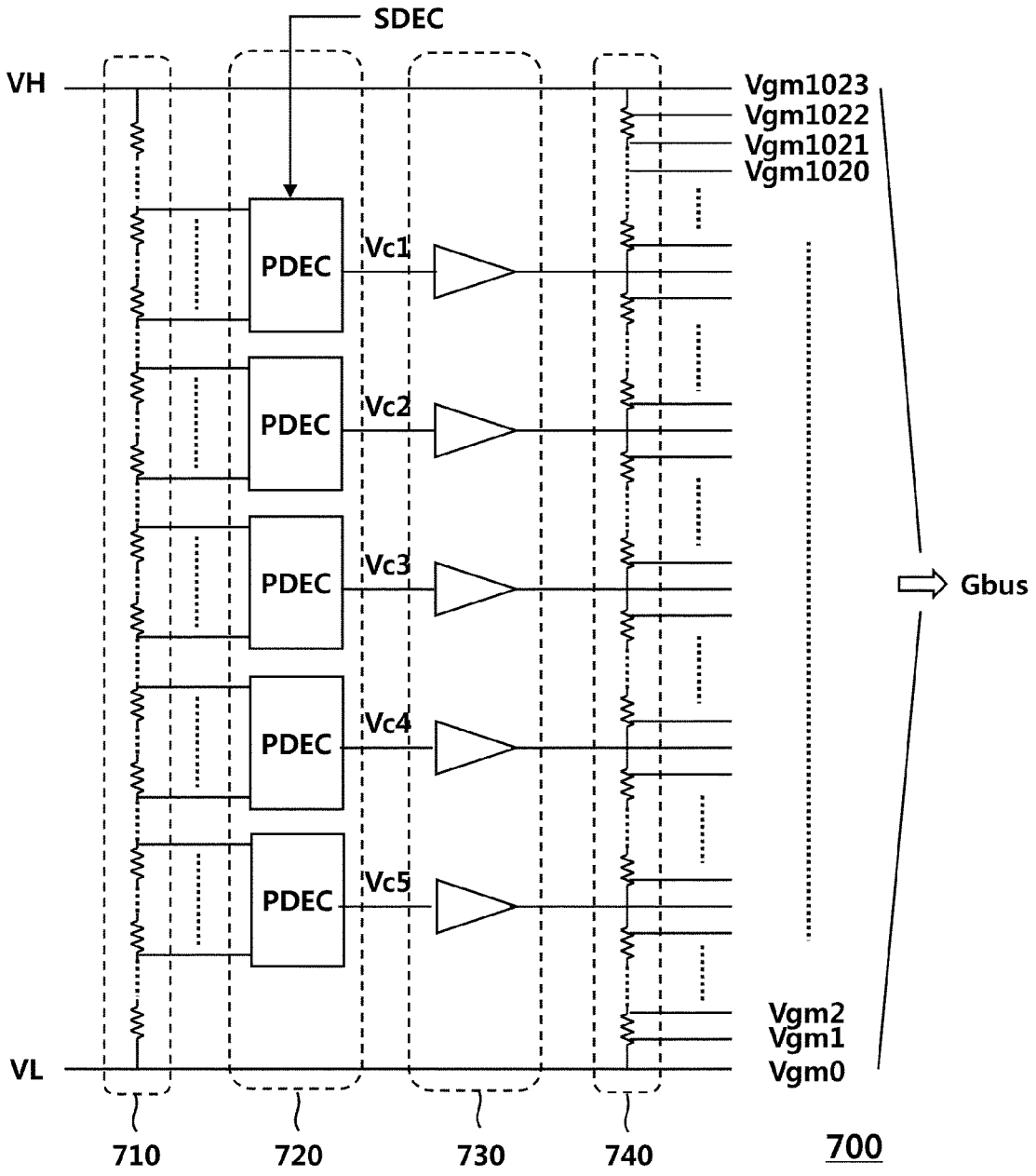
FIG. 7 is a configuration diagram of a first example of a gamma voltage circuit according to an embodiment.

FIG. 7 is a configuration diagram of a first example of a gamma voltage circuit according to an embodiment.

Referring to FIG. 7, a gamma voltage circuit 700 may comprise a first resistor string 710, a decoder 720, gamma buffers 730, and a second resistor string 740.

The first resistor string 710 may comprise a plurality of resistances connected in series and divide reference voltages VH, VL using these resistances. The first resistor string 710 may be connected with a reference high voltage VH at its one end and with a reference low voltage at its other end. In some of the plurality of resistances composing the first resistor string 710, nodes may be formed and divided voltages may be outputted through such nodes. Here, the resistances composing the first resistor string 710 may have practically the same resistance values.

In the data driving device, a plurality of gamma voltage circuits 700 may be disposed and the plurality of gamma voltage circuits 700 may be provided with the reference voltages VH, VL by a same source. The plurality of gamma voltage circuits 700 may minimize the differences among gamma voltages using the same source.

The decoder 720 may comprise a plurality of decoding blocks PDEC and select a plurality of intermediate voltages Vc1-Vc5 from the first resistor string 710 using the plurality of decoding blocks PDEC. For example, each decoding block PDEC may receive a plurality of divided voltages from the first resistor string 710, select one of the plurality of divided voltages, and output a selected voltage as an intermediate voltage Vc1-Vc5.

The decoder 720 may receive a decoding signal SDEC and select the plurality of intermediate voltages Vc1-Vc5 according to the decoding signal SDEC. For example, each decoding block PDEC may individually receive a decoding signal SDEC or the decoding blocks PDEC may receive a decoding signal SDEC in common and select one of the plurality of divided voltages according to a value indicated by the decoding signal SDEC to output a selected voltage as an intermediate voltage Vc1-Vc5.

Such a process may be referred to as a programmable decoding. According to such a programmable decoding, it is possible to minutely adjust gamma curves and to reduce differences that might exist among the plurality of gamma voltage circuits.

The intermediate voltages Vc1-Vc5 outputted from the decoder 720 may be transmitted to the gamma buffers 730. The gamma buffers 730 may buffer the intermediate voltages Vc1-Vc5, and then, output them to the second resistor string 740.

The second resistor string 740 may comprise a plurality of resistances connected in series and divide the reference voltages VH, VL and the intermediate voltages Vc1-Vc5 using the resistances so as to generate a plurality of gamma voltages Vgm0-Vgm1023.

The second resistor string 740 may receive the reference voltages VH, VL and voltages outputted from the gamma buffers 730. The reference high voltage VH may be connected to one end of the second resistor string 740 and the reference low voltage VL may be connected to the other end of the second resistor string 740. The voltages outputted from the gamma buffers 730 may be connected to nodes formed in some of the plurality of resistances composing the second resistor string 740.

The second resistor string 740 may output the gamma voltages Vgm0-Vgm1023 generated in such a way to the gamma bus.

Figure 8:
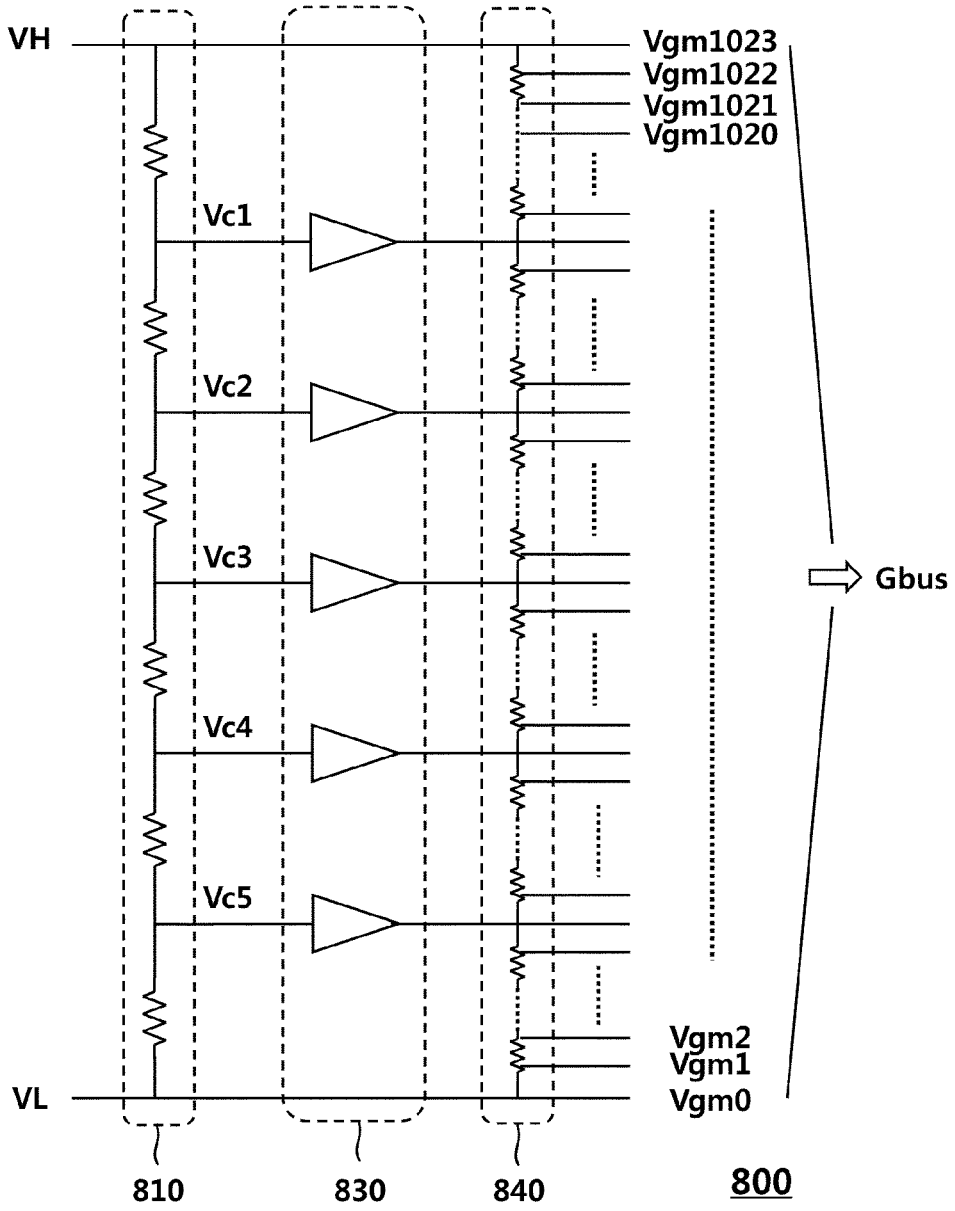
FIG. 8 is a configuration diagram of a second example of a gamma voltage circuit according to an embodiment.

FIG. 8 is a configuration diagram of a second example of a gamma voltage circuit according to an embodiment.

Referring to FIG. 8, a gamma voltage circuit 800 may comprise a first resistor string 810, gamma buffers 830, and a second resistor string 840.

The first resistor string 810 may comprise a plurality of resistances connected in series and divide reference voltages VH, VL using these resistances. The first resistor string 810 may be connected with a reference high voltage VH at one end and with a reference low voltage VL at the other end. In some of the plurality of resistances composing the first resistor string 810, nodes may be formed and intermediate voltages Vc1-Vc5 may be outputted through these nodes. Here, the resistances composing the first resistor string 810 may have the practically same resistance values.

The gamma buffers 830 may buffer the intermediate voltages Vc1-Vc5, and then, output them to the second resistor string 840.

The second resistor string 840 may comprise a plurality of resistances connected in series and divide the reference voltages VH, VL and the intermediate voltages Vc1-Vc5 using these resistances so as to generate a plurality of gamma voltages Vgm0-Vgm1023.

The second resistor string 840 may receive the reference voltages VH, VL and voltages outputted from the gamma buffers 830. The reference high voltage VH may be connected to one end of the second resistor string 840 and the reference low voltage VL may be connected to the other end of the second resistor string 840. The voltages outputted from the gamma buffers 830 may be connected to nodes formed in some of the plurality of resistances composing the second resistor string 840.

The second resistor string 840 may output the gamma voltages Vgm0-Vgm1023 generated in such a way to the gamma bus Gbus.

Figure 9:
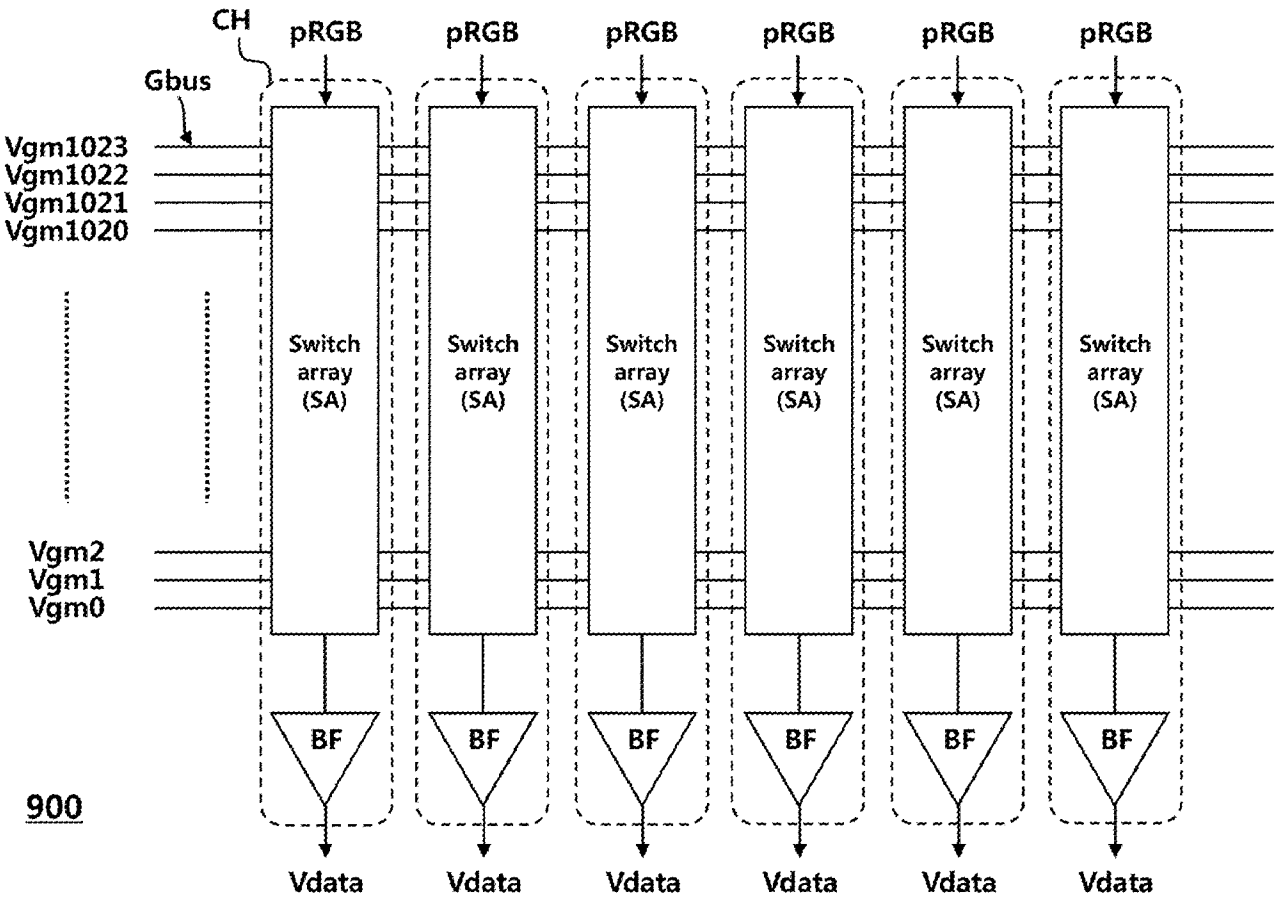
FIG. 9 is a diagram illustrating a process of generating data voltages using gamma voltages in a data driving device according to an embodiment.

FIG. 9 is a diagram illustrating a process of generating data voltages using gamma voltages in a data driving device.

Referring to FIG. 9, a data driving device 900 may comprise a plurality of channel circuits CH and each channel circuit CH may comprise a switch array SA and an output buffer BF.

A gamma bus Gbus may be disposed to traverse the respective channel circuits CH and be connected with the switch arrays of the respective channel circuits CH.

Each switch array SA may comprise a plurality of switches. Each switch may be connected with each bus line composing the gamma bus Gbus. Gamma voltages Vgm0-Vgm1023 are supplied through the respective bus lines and the switch array SA may select one of the bus lines so that a gamma voltage of the selected bus line may be outputted as a data voltage.

The output buffer BF may buffer the data voltage and output it.

The switch array SA may select one of the plurality of gamma voltages Vgm0-Vgm1023 according to a greyscale value of pixel image data pRGB. The switch array SA may be comprised in the aforementioned DAC.

What is claimed is:

1. A semiconductor integrated circuit for driving a display, comprising:

a plurality of channel circuits, each of the plurality of channel circuits comprises a digital-analog converter (DAC) to select one of a plurality of gamma voltages according to pixel image data and to generate a data voltage, and supplies the data voltage through a data line connected with sub-pixels;

a gamma bus to provide a path through which the plurality of gamma voltages are transmitted to the DACs of the respective plurality of channel circuits; and a plurality of gamma voltage circuits to generate the plurality of gamma voltages by dividing reference voltages and to be connected with the gamma bus at divided points, wherein each pixel comprises a first sub-pixel having a first color, wherein the gamma bus comprises a first sub gamma bus to which channel circuits to drive the first sub-pixels are connected, and wherein the plurality of gamma voltage circuits comprises gamma voltage circuits connected to the first sub gamma bus at points spaced apart from each other.

2. The semiconductor integrated circuit of claim 1, wherein the plurality of channel circuits are disposed along a first direction and the plurality of gamma voltage circuits are disposed to be spaced apart from each other along the first direction.

3. The semiconductor integrated circuit of claim 1, wherein each of the pixels comprises a plurality of sub-pixels, the gamma bus comprises a plurality of sub gamma buses, a channel circuit that drives the first sub-pixel among the plurality of sub-pixels and a channel circuit that drives a second sub-pixel are connected with the first sub gamma bus and a channel circuit that drives a third sub-pixel is connected with a second sub gamma bus, wherein a number of gamma voltage circuits connected with the first sub gamma bus is greater than a number of gamma voltage circuits connected with the second sub gamma bus, wherein the first sub-pixel and the second sub-pixel have a same color, and the first sub-pixel and the third sub-pixel have different colors.

4. The semiconductor integrated circuit of claim 1, wherein each gamma voltage circuit comprises a first resistor string to divide the reference voltages, a decoder to select a plurality of intermediate voltages from the first resistor string, gamma buffers to buffer the intermediate voltages, and a second resistor string to divide voltages outputted from the gamma buffers so as to generate the plurality of gamma voltages.

5. The semiconductor integrated circuit of claim 4, wherein the decoder receives a decoding signal and selects the plurality of intermediate voltages according to the decoding signal.

6. The semiconductor integrated circuit of claim 1, wherein each of the sub-pixels comprises red (R), green (G), or blue (B) organic light emitting diodes (OLEDs) and the plurality of gamma voltages have different gamma curves for the respective RGB OLEDs.

7. The semiconductor integrated circuit of claim 1, wherein the DAC comprises a switch array comprising a plurality of switches and selects one of the plurality of gamma voltages by turning on one of the plurality of switches.

8. The semiconductor integrated circuit of claim 1, wherein the plurality of gamma voltage circuits are provided with the reference voltages by a same source.

9. A semiconductor integrated circuit for driving a display, comprising:

a timing control circuit to supply a synchronization signal for a display period and pixel image data;

a plurality of channel circuits, each of the plurality of channel circuits comprises a digital-analog converter (DAC), to select one of a plurality of gamma voltages according to pixel image data and to generate a data voltage, and supplies the data voltage through a data line connected with sub-pixels;

a gamma bus to provide a path through which the plurality of gamma voltages are transmitted to the DACs of the respective plurality of channel circuits;

a plurality of gamma voltage circuits to generate the plurality of gamma voltages by dividing reference voltages and to be connected with the gamma bus at divided points, and a plurality of output pads respectively connected with data lines, wherein the plurality of channel circuits are disposed in parallel with the plurality of output pads and the plurality of gamma voltage circuits are disposed between the plurality of channel circuits, wherein the plurality of channel circuits are divided into a plurality of channel circuit blocks by the plurality of gamma voltage circuits, and wherein sizes of outermost channel circuit blocks are smaller than sizes of inner channel circuit blocks.

10. The semiconductor integrated circuit of claim 9, further comprising a data bus to transmit the pixel image data, wherein each channel circuit further comprises a latch circuit to latch the pixel image data from the data bus.

11. The semiconductor integrated circuit of claim 9, further comprising a gate driving circuit to generate a gate driving signal of a thin film transistor (TFT) disposed in each sub-pixel according to a control signal received from the timing control circuit.

12. The semiconductor integrated circuit of claim 9, wherein a gamma voltage circuit receives a decoding signal and adjusts the plurality of gamma voltages according to the decoding signal.

13. The semiconductor integrated circuit of claim 12, wherein the timing control circuit transmits the decoding signals to the respective gamma voltage circuits.

* * * * *